US007483038B2

(12) United States Patent
Oh

(10) Patent No.: US 7,483,038 B2
(45) Date of Patent: Jan. 27, 2009

(54) CONTENT REPRODUCTION APPARATUS AND METHOD FOR DISPLAYING A GUI SCREEN THEREOF

(75) Inventor: Young-Seuk Oh, Seoul (KR)

(73) Assignee: Samsung Electroncis Co., Ltd., Suwon-Si (KR)

( * ) Notice: Subject to any disclaimer, the term of this patent is extended or adjusted under 35 U.S.C. 154(b) by 0 days.

(21) Appl. No.: 11/312,913

(22) Filed: Dec. 21, 2005

(65) Prior Publication Data

US 2006/0152528 A1 Jul. 13, 2006

(30) Foreign Application Priority Data

Jan. 11, 2005 (KR) ..... 10-2005-0002426

(51) Int. Cl.
*G09G 5/02* (2006.01)

(52) U.S. Cl. ..... 345/594; 345/593; 345/601

(58) Field of Classification Search ..... 345/594, 345/690; 348/447; 382/167
See application file for complete search history.

(56) References Cited

U.S. PATENT DOCUMENTS

2002/0044686 A1* 4/2002 Yamazaki ..... 382/167
2003/0147009 A1 8/2003 Saiki et al. ..... 348/563
2004/0213542 A1 10/2004 Hamasaka et al. ..... 386/46
2005/0052476 A1* 3/2005 Tyrell ..... 345/690
2005/0099535 A1* 5/2005 Yu et al. ..... 348/447

FOREIGN PATENT DOCUMENTS

| | | |
|---|---|---|
| CN | 1394327 | 1/2003 |
| EP | 0 734 180 A2 | 9/1996 |
| JP | 2000-305549 | 11/2000 |
| JP | 2002-182631 | 6/2002 |
| KR | 1020000010407 | 2/2000 |
| KR | 1020030074862 | 9/2003 |

* cited by examiner

*Primary Examiner*—Kee M Tung
*Assistant Examiner*—Jacinta Crawford
(74) *Attorney, Agent, or Firm*—Roylance, Abrams, Berdo & Goodman, LLP

(57) ABSTRACT

Provided is a content reproduction apparatus and a method for displaying a GUI screen thereof. The content reproduction apparatus of the present invention comprises a nonvolatile memory unit for storing lookup tables which are used for generating a GUI screen to be displayed on the external output apparatus; a lookup table adjusting unit for adjusting a color range of colors used in the lookup table; and a controlling unit for generating the GUI screen by using the adjusted lookup table on which the adjusted color range is applied, and for transmitting the GUI screen to the external output apparatus.

9 Claims, 4 Drawing Sheets

CONTENT REPRODUCTION APPARATUS AND METHOD FOR DISPLAYING A GUI SCREEN THEREOF

CROSS-REFERENCE TO RELATED PATENT APPLICATIONS

This application claims the benefit under 35 U.S.C. § 119 (a) from Korean Patent Application No. 2005-2426, filed Jan. 11, 2005, in the Korean Intellectual Property Office, the entire disclosure of which is hereby incorporated by reference.

BACKGROUND OF THE INVENTION

1. Field of the Invention

The present invention relates to a content reproduction apparatus and method for displaying a Graphical User Interface (GUI) screen thereof. More specifically, the present invention relates to a content reproduction apparatus that can provide various content to a connected external output apparatus, and method for displaying a GUI screen thereof.

2. Description of the Related Art

A content reproduction apparatus operates to transmit, to an output apparatus, image and/or sound content stored on a mass storage medium such as Hard Disk Drive (HDD) or an optical disk. Most often, either a high performance digital television or a low performance analog television is used as the external output apparatus. Nowadays, despite digital televisions being rapidly developed, digital televisions remain relatively expensive. Thus, because of the cost, many people continue to use analog televisions despite their lower performance.

Digital televisions benefit from being able to automatically adjust picture qualities such as saturation and brightness, but most analog televisions do not have this automatic adjustment function. The automatic adjustment function is useful for removing screen distortion which frequently occurs when a bright image portion and a dark image portion are adjacent, such as in a GUI screen. Accordingly, digital televisions can remove screen distortion to improve picture performance of a GUI screen, whereas analog televisions cannot. Moreover, recent content reproduction apparatuses are able to provide images with a wider range of colors with greater degrees of intensity, thus increasing the likelihood of the above-mentioned screen distortion.

Accordingly, there is a need for an improved content reproduction apparatus that can adjust color properties, such as saturation and brightness, of GUI screen when used with low performance external output apparatus having no automatic screen adjustment function.

SUMMARY OF THE INVENTION

An aspect of the present invention is to address at least the above problems and/or disadvantages and to provide at least the advantages described below. Accordingly, an aspect of the present invention is to provide a content reproduction apparatus and method for displaying a GUI screen which adjusts a color range of a lookup table used for generating the GUI screen and adjusts a color property such as saturation and brightness of the GUI screen.

According to an aspect of the present invention, the content reproduction apparatus provides content to an external output apparatus. The content reproduction apparatus comprises a nonvolatile memory unit for storing lookup tables which are used for generating a GUI screen to be displayed on the external output apparatus. Further, the content reproduction apparatus comprises a lookup table adjusting unit for adjusting a color range of colors used in the lookup table. Moreover, the content reproduction apparatus comprises a controlling unit for generating the GUI screen by using the adjusted lookup table on which the adjusted color range is applied, and for transmitting the screen to the external output apparatus.

The lookup table adjusting unit may comprise an average value calculating unit for calculating an average value of at least one color value in the color range of at least one color. Further, the lookup table adjusting unit may comprise an adjusted color value calculating unit for calculating an adjusted color value based on an adjusted value obtained by adjusting a difference of the average value and each color value by a color range change value. Moreover, the lookup table adjusting unit may comprise a unit for generating an adjusted lookup table which adjusts the lookup table by applying the calculated adjusted color value to generate the adjusted lookup table.

It is preferable that the adjusted color value calculating unit calculates the adjusted color value $A_{n_k}$ according to an equation: $A_{n_k}=A_k+(A_{mean}-A_k)\times M$, where $A_k$ is a kth color value in a color range of color A consisting of the lookup table, and $A_{mean}$ is an average value of color values in the color range of the color A, and M is a color range change value, and n has a range of 1 to n, and n is the number of the color values in the color range of the color A.

The content reproduction apparatus further includes an inputting unit to which the color range change value is inputted, wherein the control unit transmits the inputted color range change value to the lookup table adjustment unit to allow the value to be used for generating the adjusted color value.

The content reproduction apparatus further includes a menu screen storing unit for storing menu screens to be displayed on the external output apparatus and through which the color range change value is inputted. When the color range change value is inputted, based on the menu screen, and transmitted from the external output apparatus, the control unit transmits the color range change value to the lookup table adjustment unit to be used for the calculation of the adjusted color value.

It is preferable that the GUI screen is an OSD screen. The method for displaying a GUI screen of a content reproduction apparatus may comprises a step for adjusting a color range of colors used in the lookup table for generating the GUI screen to be displayed on the external, output apparatus. Further a step may be provided for generating the GUI screen by using the adjusted lookup table on which the adjusted color range is applied. Moreover, a step maybe provided for transmitting the generated GUI screen to the external output apparatus.

The step for adjusting includes a step for calculating an average value of at least one color value in the color range of at least one color. Further, a step may be provided for calculating an adjusted color value based on an adjusted value obtained by adjusting a difference of the average value and each color value by a color range change value. Moreover, a step may be provided for adjusting the lookup table by applying the calculated adjusted color value to generate the adjusted lookup table.

The adjusted color value $A_{n_k}$ is calculated according to a following equation: $A_{n_k}=A_k+(A_{mean}-A_k)\times M$, where $A_k$ is a kth color value in a color range of color A consisting of the lookup table, and $A_{mean}$ is an average value of color values in the color range of the color A, and M is a color range change value, and n has a range of 1 to n, and n is the number of the color values in the color range of the color A.

By the above, aspects of the present invention have an advantage of adjusting a color property such as saturation and brightness of GUI screen on a low performance external output apparatus having no automatic screen adjustment function.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
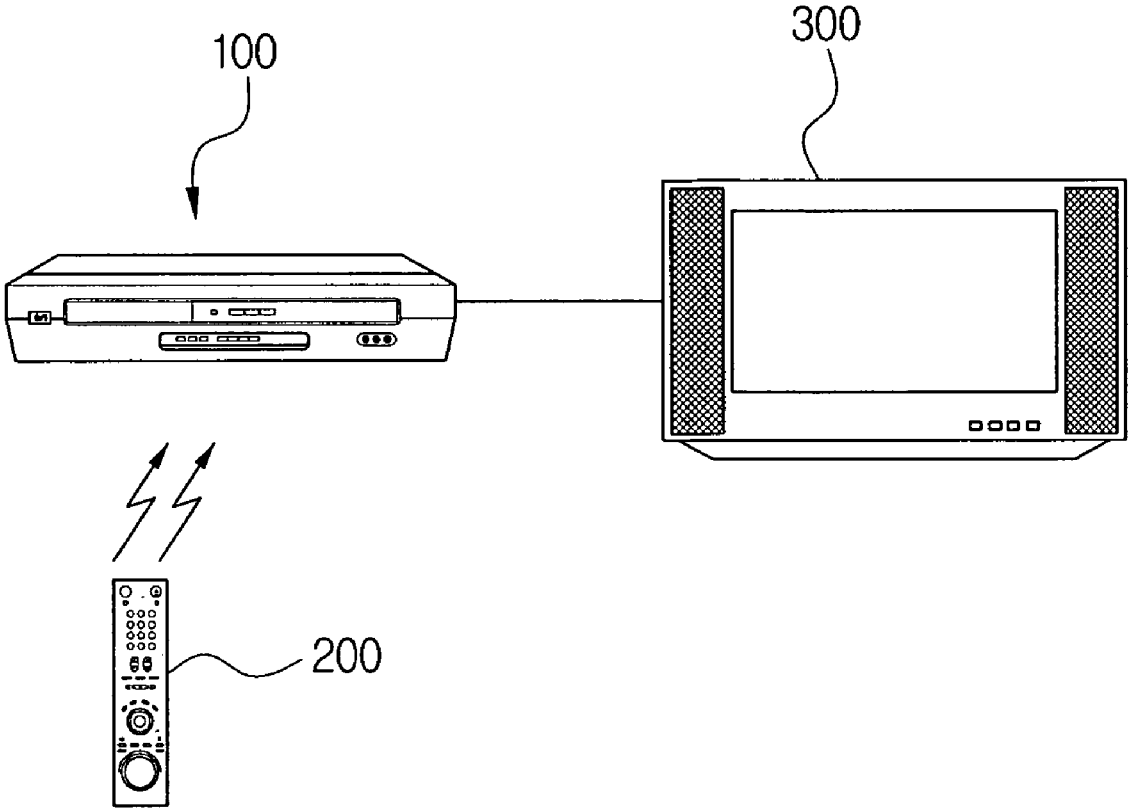
FIG. 1 illustrates a content reproduction system according to a preferred embodiment of the present invention.

FIG. 1 illustrates a content reproduction system according to a preferred embodiment of the present invention. Referring to FIG. 1, the content reproduction system comprises a content reproduction apparatus 100 for reproducing content read from a mass storage medium or an optical disk, and an external output apparatus 300 for providing a user with the content reproduced from the content reproduction apparatus 100. In addition, the content reproduction apparatus 100 can be controlled by a remote control 200. The content read from the mass storage medium or optical disk may be any type or mixture of types of content. Preferably, the content is image and/or sound content. The mass storage medium or optical disk read by the content reproduction apparatus 100 can be any type or mixture of types of storage medium that store content. An exemplary mass storage medium is a Hard Disk Drive (HDD).

Exemplary optical disks include read-only optical disks such as Compact Disk-Read Only Memory (CD-ROM), Digital Versatile Disk-Read Only Memory (DVD-ROM), High Definition Digital Versatile Disk-Read Only Memory (HD DVD-ROM), and Blu-ray Disc-Read Only Memory (BD-ROM); write-once optical disks such as Compact Disk-Recordable (CD-R), Digital Versatile Disk-Recordable (DVD-R and DVD+R), High Definition-Digital Versatile Disk Recordable (HD DVD-R), and Blu-ray Disc Recordable (BD-R); and rewritable optical disks such as CD-ReWritable (CD-RW), Digital Versatile Disk-ReWritable (DVD-RW and DVD+RW), Digital Versatile Disk-Randon Access Memory (DVD-RAM), High Definition-Digital Versatile Disk-Re-Writable (HD DVD-RW), and Blu-ray Disc ReWritable (BD-RW). Of course, any other optical disk type may be used as well. In addition, exemplary content reproduction apparatuses include a Compact Disk Video player (CD-Video player), Compact Disk Video recorder (CD-Video recorder), Digital Video Disk player (DVD player), Digital Video Disk recorder (DVD recorder), High Definition Digital Versatile Disk player (HD DVD player), High Definition Digital Versatile Disk recorder (HD DVD recorder), Blue-ray Disc player (BD player), Blue-ray Disc recorder (BD recorder), and a Digital Video Recorder (DVR). Of course, any other content reproduction apparatus type may be used as well. An, exemplary external output apparatus is a digital television or an analog television. Of course, any other output apparatus type, internal or external, may be used as well. In FIG. 1 an analog television is preferably used as the external output apparatus 300.

According to an embodiment of the present invention, in a lookup table, used in the generation of the GUI screen, is adjusted according to a color range change value inputted by a user. Here, the color range change value is a parameter input by a user used for adjusting a color property such as saturation and brightness of the GUI screen. For example, when a user inputs a positive color range change value, the color range applied to the GUI screen is reduced, and on the other hand, when a user inputs a negative color range change value, the color range being applied to the GUI screen is increased.

In other hand, when a very bright part or a very dark part of the GUI screen causes a screen distortion phenomenon on adjacent areas thereof, the screen distortion phenomenon can be removed. The screen distortion phenomenon can be removed by adjusting the color range change value and by reducing a difference of a color property, such as saturation and brightness, between the adjacent areas.

Hereinafter, for the sake of convenience, an On Screen Display (OSD) screen is an exemplary GUI screen. However, any type of GUI screen can be the GUI screen for any embodiment of the present invention.

Figure 2:
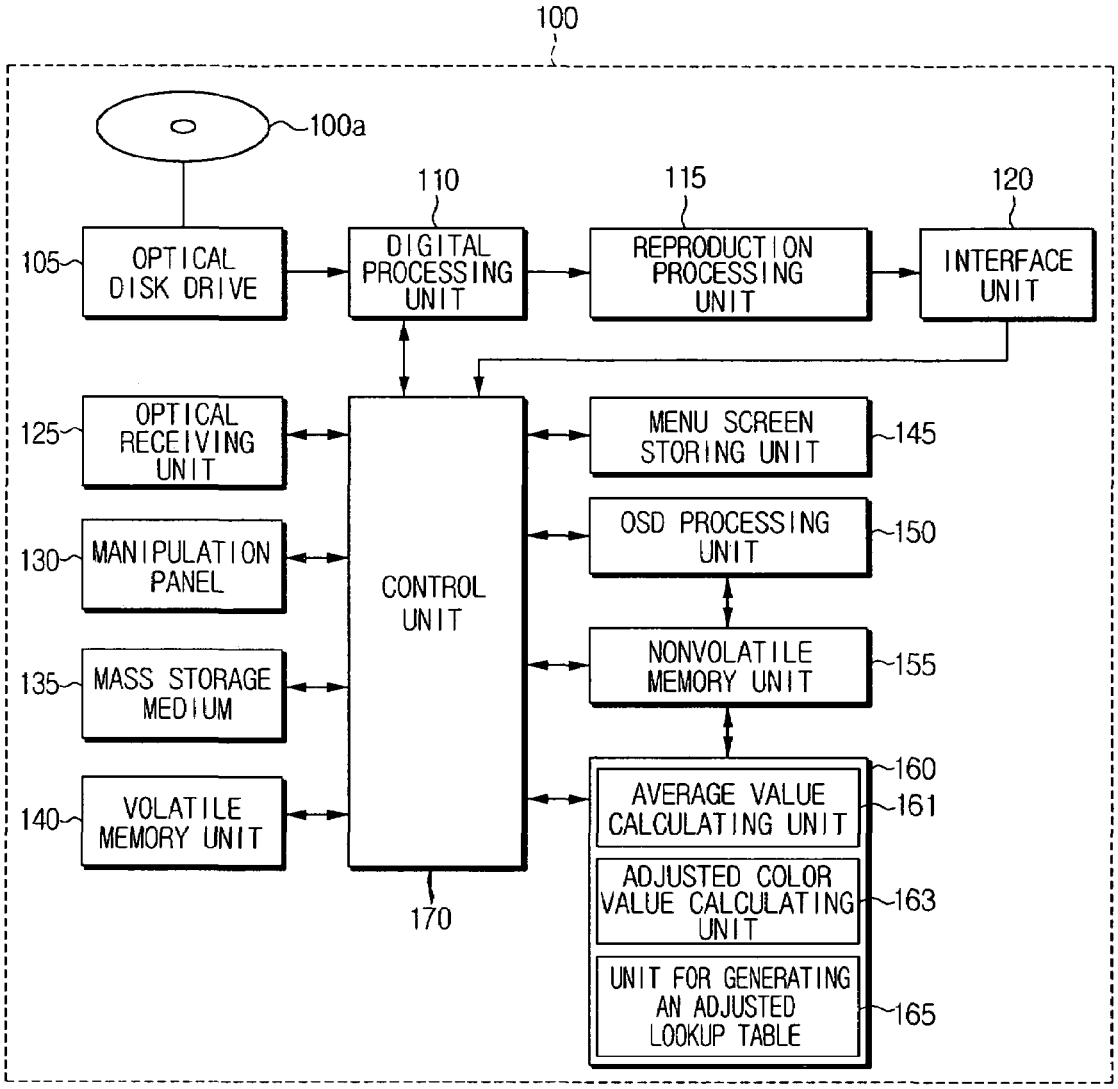
FIG. 2 illustrates internal components of a reproduction apparatus according to an embodiment of the present invention.

FIG. 2 illustrates internal components of a reproduction apparatus according to an embodiment of the present invention.

Referring to FIG. 1 and FIG. 2, the content reproduction apparatus 100 according to an embodiment of the present invention comprises an optical disk drive 105, a digital processing unit 110, a reproduction processing unit 115, an interface unit 120, an optical receiving unit 125, a manipulation panel 130, a mass storage medium 135, volatile memory unit 140, a menu screen storing unit 145, an OSD processing unit 150, nonvolatile memory unit 155, a lookup table adjusting unit 160 and a control unit 170. The optical disk drive 105 radiates light onto an optical disk l00*a* mounted on the content reproduction apparatus 100, reads the content stored on the optical disk 100*a*, and converts the read contents into a Radio Frequency (RF) signal. Exemplary content is image and sound content.

The digital processing unit 110 is preferably a Digital Signal Processor (DSP) that amplifies the RF signal for conversion into an electric signal and performs a digital processing on the converted electric signal. In other word, the digital processing unit 110 digitally processes the RF signal to obtain a video signal and an audio signal.

The reproduction processing unit 115 combines the video signal outputted from the digital processing unit 110 and an OSD signal from the OSD processing unit 150 to generate an image signal. In addition, the reproduction processing unit 115 converts the combined image signal into a signal which can be outputted from the external output apparatus 300. Further, the reproduction processing unit 115 converts an audio signal outputted from the digital processing unit 110 into a signal which can be outputted from the external output apparatus 300.

The interface unit 120 is for interfacing with the external output apparatus 300. Through the interface unit 120, a signal from the reproduction processing unit 115 is transmitted to the external output apparatus 300 and various menu screens are provided to the external output apparatus 300. In addition, through the interface unit 120, a color range change value can be received from the external output apparatus 300.

An optical receiving unit 125 is used as an interface for receiving a signal from remote control 200. The signal received at optical receiving unit 125 represents key manipulation on the remote control 200 by the user. The optical receiving unit 125 outputs the signal received from remote control 200 to the control unit 170.

According to an embodiment of the present invention, a signal received at optical receiving unit 125 corresponds to a display menu command to display the lookup table adjustment menu. According to an embodiment of the present invention, while the lookup table adjustment menu is displayed, a change value of a color range is inputted through a key manipulation of remote control 200, and a signal representing the key manipulation is received by the optical receiving unit 125.

The manipulation panel 130 is a user interface for receiving user input and forwarding a user manipulation signal to control unit 170 to set or perform functions supported by the content reproduction apparatus 100. Preferably, the manipulation panel 130 is provided with a plurality of manipulation keys, number keys, and direction keys. Of course any of a number of different keys can be provided as well.

According to an embodiment of the present invention, a command can be inputted through manipulation panel 130 that is associated with the lookup table adjustment menu.

Figure 3:
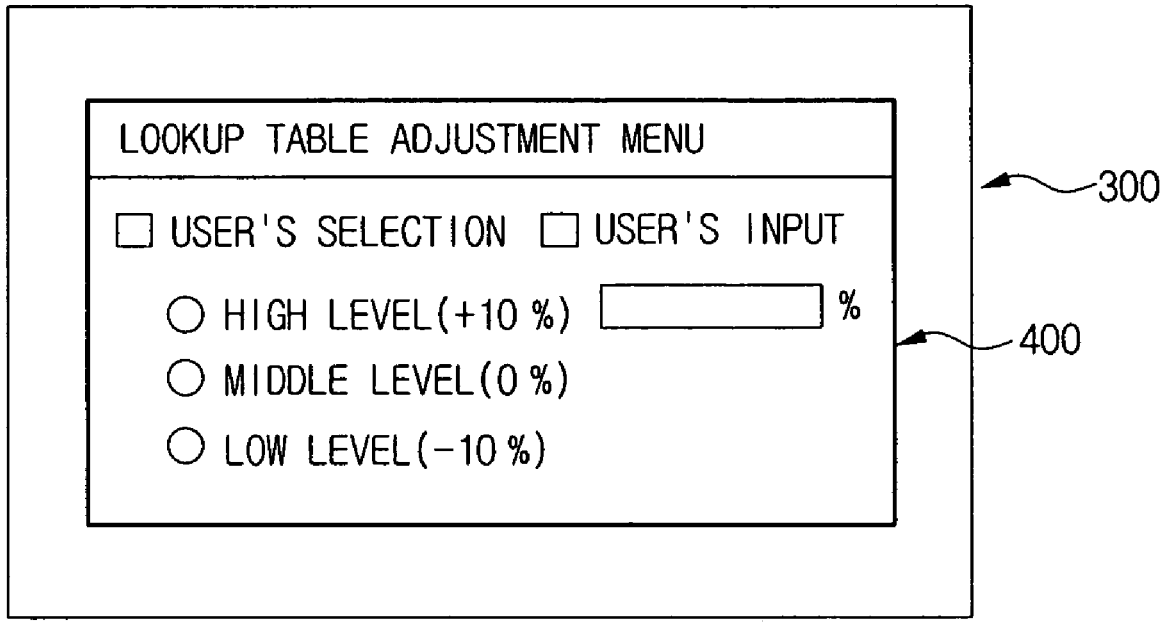
FIG. 3 illustrates an embodiment of a lookup table adjustment menu according to an embodiment of the present invention.

According to an embodiment of the present invention, a color range change value can be inputted, through the manipulation panel 130. A change value can be directly inputted as the color range change value. For example, a value such as ten percent and twenty percent can be directly inputted through the manipulation panel 130. In addition, another embodiment may have a differing structure wherein the color range change value may be classified into an upper level, a middle level and a lower level, and the color range change value is predetermined according to each level. Meanwhile, another embodiment may have a differing structure wherein the color range change value is inputted through a menu screen 400 for adjusting the lookup table, as shown in FIG. 3.

In the mass storage medium 135, a plurality of image content, sound content, image/sound content, as well as other content are stored. Preferably, the content is stored after being compressed using one of any compression method such as Motion Picture Experts Group (MPEG) compression method. A Hard Disk Drive (HDD) may be used as the mass storage medium 135.

The volatile memory unit 140 stores temporary data generated during a reproduction operation of the content reproduction apparatus 100, and data generated during other operations.

The menu screen storage unit 145 stores data for various menu screens provided by the content reproduction apparatus 100. Preferably, flash memory or other types of memory are used as the menu screen storage unit 145. A menu screen storing unit 145 of an embodiment of the present invention stores a menu screen 400 for adjusting a lookup table, as shown in FIG. 3. This lookup table adjustment menu can be a submenu of a main setup menu.

The OSD processing unit 150 performs OSD processing for various menu screens to be outputted through the external output apparatus 300. In other words, the OSD processing unit 150 performs OSD processing before transmitting the various menu screens, stored in the menu screen storing unit 145, to the external output apparatus 300. The menu screen which has undergone OSD processing is transmitted to the external output apparatus 300 through the interface unit 120 under control of the control unit 170.

In addition, the OSD processing unit 150 performs OSD processing by using a lookup table stored in the volatile memory unit 140 and index values corresponding to the table.

The nonvolatile memory unit 155 stores a control program used for controlling operation of the content reproduction apparatus 100. In addition, a codec program such as DivX can be stored in the nonvolatile memory unit 155. DivX is a digital video compression format based on Motion Picture Experts Group-4 (MPEG-4) technology.

In an embodiment of the present invention, the nonvolatile memory unit 155 stores the lookup table. In addition, index values corresponding to the lookup table are stored in the nonvolatile memory unit 140. As described above, the lookup table and the index values are used for generating an OSD screen by the OSD processing unit 150.

In an embodiment of the present invention, the lookup table adjusting unit 160 adjusts the lookup table stored in the nonvolatile memory unit 155. The lookup table adjusting unit 160 includes an average value calculating unit 161, an adjusted color value calculating unit 163 and a unit for generating an adjusted lookup table 165.

An adjustment of the lookup table is performed through three steps. First, an average value calculating unit 161 of the lookup table adjusting unit 160 calculates an average value of color values in the color range for at least one or more of the colors Red (R), Green (G) and/or Blue (B). R, G and B are colors used in the lookup table. The average values $R_{mean}$, $G_{mean}$ and $B_{mean}$ are calculated by a following Equation Set 1.

$$\left.\begin{aligned} R_{mean} &= \sum R_k / n \\ G_{mean} &= \sum G_k / n \\ B_{mean} &= \sum B_k / n \end{aligned}\right\} \qquad \text{Equation Set 1}$$

Here, k is 1 to n, and n is the number of the color values in the color range of each color R, G and B. Here, $R_k$ is the kth color value in a color range of the color R, and $G_k$ is the kth color value in a color range of the color G, and $B_k$ is the kth color value in a color range of the color B.

The adjusted color value calculating unit 163, of the lookup table adjusting unit 160, uses the generated average value to adjust a difference of the average value and each color value by a color range change value in order to calculate an adjusted color value. The adjusted color value $R_{n_k}$, $G_{n_k}$ and $B_{n_k}$ are calculated by a following Equation Set 2.

$$\left.\begin{aligned} R_{n_k} &= R_k + (R_{mean} - R_k) \times M \\ G_{n_k} &= G_k + (G_{mean} - G_k) \times M \\ B_{n_k} &= B_k + (B_{mean} - B_k) \times M \end{aligned}\right\} \quad \text{Equation Set 2}$$

Here, k is 1 to n, and n is the number of the color values in the color range of each color R, G and B. Here, $R_k$ is the kth color value in a color range of color R, and $G_k$ is the kth color value in a color range of color G, and $B_k$ is the kth color value in a color range of color B. $R_{mean}$ is the average value of color values in a color range of color R, and $G_{mean}$ means the average value of color values in a color range of color G, and $B_{mean}$ means an average value of color values in a color range of color B. M is a color range change value selected by a user.

The unit for generating adjusted lookup table 165, of the lookup table adjusting unit 160, adjusts the lookup table by using the calculated adjusted color value to generate an adjusted lookup table. Here, the adjusted lookup table is a lookup table which provides a color range according to the adjusted color value.

The control unit 170 controls the content reproduction apparatus 100 according to a control program stored in the nonvolatile memory unit 155. The control unit 170 reads content stored in the mass storage medium 135, reproduces the content and transmits the reproduced content to the external output apparatus 300 through the interface unit 120.

According to an embodiment of the present invention, when the display menu command, for initiating the display of the lookup table adjustment menu, is received from remote control 200, the control unit 170 controls in a manner such that the lookup table adjustment menu, stored in the menu screen storing unit 145, is read and then transmitted to the external output apparatus 300.

According to an embodiment of the present invention, when the display menu command, for initiating the display of the lookup table adjustment menu, is inputted to the manipulation panel 130, the control unit 170 of an embodiment of the present invention controls in a manner such that the lookup table adjustment menu, stored in the menu screen storing unit 145, is read and then transmitted to the external output apparatus 300.

According to an embodiment of the present invention, when a color range change value is received through interface unit 120, the control unit 170 controls the interface unit 120 in such a manner that the color range change value is routed to the lookup table adjusting unit 160. Further, when the color range change value is received at the optical receiving unit 125 from remote controller 200 or when the color range change value is directly received through the manipulation panel 130, the control unit 170 controls in a manner such that the color range change value is routed to the lookup table adjusting unit 160.

According to embodiment of the present invention, when the adjusted lookup table is generated, the control unit 170 controls in such a manner that the adjusted lookup table is updated in the volatile memory unit 155. Accordingly, when generating an OSD screen, the updated adjusted lookup table in the nonvolatile memory unit 155 is used.

FIG. 3 illustrates an embodiment of a lookup table adjustment menu according to an embodiment of the present invention.

Referring to FIG. 1 to FIG. 3, when a user inputs a display menu command of a lookup table adjustment menu, a lookup table adjustment menu 400 in FIG. 3 is read from the menu screen storing unit 145 and then transmitted to the external output apparatus 300.

The user can input a color range change value through the menu screen 400 for adjusting the lookup table. For this input process, menu screen 400 for adjusting a lookup table permits input by either a user's selection or a user's input operation. In FIG. 3, check boxes allow one of the input manners to be chosen. When input by a user's selection is selected, the user can select a high level, a middle level or a low level. When the high level is selected, the color range change value is set to +10%. Also, when the middle level is selected, the original color range is used. Additionally, when the low level is selected, the color range change value is set to −10%.

Meanwhile, when input by a user's input operation is selected, the user can directly input the color range change value. Like in the above description, the color range change value inputted in the menu screen 400 for adjusting a lookup table, is routed to the content reproduction apparatus 100 to be used for an adjustment of the lookup table.

Figure 4:
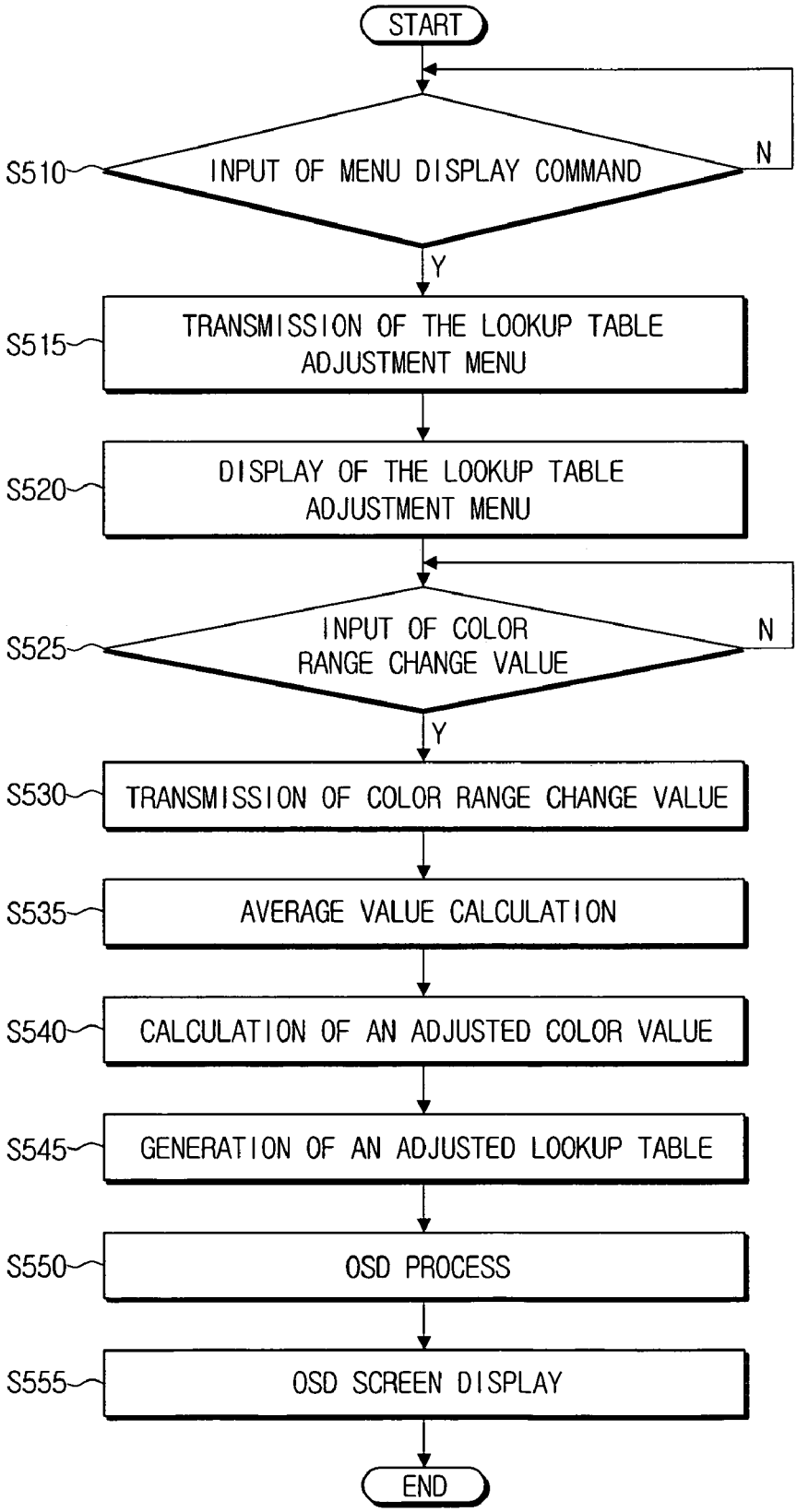
FIG. 4 is a flow chart illustrating a method for displaying an OSD screen of the content reproduction apparatus according to an embodiment of the present invention.

FIG. 4 is a flow chart illustrating a method for displaying an OSD screen of the content reproduction apparatus according to an embodiment of the present invention.

Referring to FIG. 1 to FIG. 4, when a display menu command for displaying a lookup table adjustment menu is inputted by a user through remote control 200 or manipulation panel 130 (S510), the menu screen 400 for adjusting a lookup table, stored in the menu screen storing unit 145, is read under control of the control unit 170 and then transmitted to an external output apparatus (S515).

Further, the transmitted menu screen 400 is displayed on the external output apparatus 300 (S520). If a color range change value is inputted on the lookup table adjustment menu 400 (S525), the color range change value is transmitted to the contents reproduction apparatus 100 (S530). In addition, an average value of color values in a color range of one or more colors, used for the lookup table, is calculated by the average value calculating unit 161 of the lookup table adjusting unit 160 (S535). It is preferred that this average value is calculated using Equation Set 1.

In addition, the adjusted color value calculating unit 163 of the lookup table adjusting unit 160, calculates an adjusted color value by adjusting a difference of the average value and a color value in a color range by a color range change value (S540), for each color value in the color range of one or more colors. It is preferred that this adjusted color value is calculated by Equation Set 2. Further, the unit for generating an adjusted lookup table 165 of the lookup table adjusting unit 160, adjusts the lookup table by using the adjusted color value of the adjusted color value calculating unit 163 for each color, and thereby an adjusted lookup table is generated (S545).

Further, in case that a display menu command is inputted, the adjusted lookup table is applied for an OSD process of the menu screen (S550). Further, the OSD processed menu screen is transmitted to the external output apparatus 300 to be displayed (S555).

Meanwhile, the contents reproduction apparatus 100 are described as an example in the above description of an embodiment of the present invention, and it is obvious that any contents record/reproduction apparatus which can output a GUI screen to an external output apparatus 300 can be included in a scope of the embodiments of the present invention.

The input components of the color range change value, namely the manipulation panel 130, remote controller 200, optical receiving unit 125 and menu screen 400 used for adjusting the lookup table as shown in FIG. 3, are described as examples. The inputting unit in the embodiments of the present invention are not limited to the above named components.

As described above, the content reproduction apparatus and the method for displaying a GUI screen thereof, according to an embodiment of the present invention, has an advantage of adjusting a color property such as saturation and brightness of a GUI screen on a low performance external output apparatus having no automatic screen adjustment function. In other word, when a very bright image part or a very dark image part on a GUI screen causes a screen distortion phenomenon on adjacent areas thereof, the screen distortion phenomenon can be removed. The screen distortion phenomenon can be removed by adjusting the color range change value and by reducing a difference of color property such as saturation and brightness between the adjacent areas.

In addition, the color range change value can be adjusted by a user, and so an embodiment of the present invention has the advantage of satisfying the various tastes users may have.

In addition, in an embodiment of the present invention, the adjustment of a color property is performed only for the GUI screen, while keeping an original color property in the reproduced content.

While the invention has been shown and described with reference to certain embodiments thereof, it will be understood by those skilled in the art that various changes in form and details may be made therein without departing from the spirit and scope of the invention as defined by the appended claims.

What is claimed is:

1. A content reproduction apparatus for providing an external output apparatus with content, comprising:

a nonvolatile memory unit for storing a lookup table used for generating a GUI screen to be displayed on the external output apparatus;

a lookup table adjusting unit for adjusting a color range of one or more colors used in the lookup table according to a calculated numerical color range change value input by a user, wherein the lookup table adjusting unit includes an average value calculating unit for calculating an average value of color values in the color range of the one or more colors, an adjusted color value calculating unit for calculating an adjusted color value based on an adjusted value obtained by adjusting a difference between the average value and each color value by a color range change value of the one or more colors, and a unit for generating an adjusted lookup table which adjusts the lookup table by applying the calculated adjusted color value to generate the adjusted lookup table; and a control unit for generating the GUI screen using the adjusted lookup table, and for transmitting the GUI screen to the external output apparatus.

2. The content reproduction apparatus as claimed in claim 1, wherein the adjusted color value calculating unit calculates the adjusted color value $A_{n_k}$ according to an equation $A_{n_k}=A_k+(A_{mean}-A_k)\times M$, where $A_k$ is a kth color value in a color range of color A in the lookup table, and $A_{mean}$ is an average value of color values in the color range of the color A, and M is a color range change value, and n has a range of 1 to n, and n is the number of the color values in the color range of the color A.

3. The content reproduction apparatus as claimed in 1, further including an inputting unit by which the color range change value is inputted, wherein the control unit sends the inputted color range change value to the lookup table adjustment unit for generating the adjusted color value.

4. The content reproduction apparatus as claimed in claim 1, further including:

a menu screen storing unit for storing a menu screen which is displayed on the external output apparatus and through which the color range change value is inputted;

wherein, when the color range change value is inputted via the menu screen and transferred from the external output apparatus, the control unit transfers the color range change value to the lookup table adjustment unit for the calculation of the adjusted color value.

5. The contents reproduction apparatus as claimed in 1, the GUI screen is an OSD screen.

6. A method for displaying a GUI screen of a content reproduction apparatus and for providing an external output apparatus with content, comprising the steps:

a) adjusting a calculated numerical color range of one or more colors in a lookup table for generating the GUI screen to be displayed on the external output apparatus, comprising:

a1) calculating an average value of color values in the color range of the one or more colors, a2) calculating an adjusted color value based on an adjusted value obtained by adjusting a difference of the average value and each color value by a color range change value of the one or more colors, and a3) adjusting the lookup table by applying the calculated adjusted color value to generate an adjusted lookup table;

b) generating the GUI screen by using the adjusted lookup table; and c) transmitting the generated GUI screen to the external output apparatus.

7. The method as claimed in claim 6, wherein the adjusted color value $A_{n_k}$ is calculated according to an equation: $A_{n_k}=A_k+(A_{mean}-A_k)\times M$, where $A_k$ is a kth color value in a color range of color A in the lookup table, and $A_{mean}$ is an average value of color values in the color range of the color A, and M is a color range change value, and n has a range of 1 to n, and n is the number of the color values in the color range of the color A.

8. The method as claimed in claim 6, wherein step a1) comprises a step of inputting a color range change value.

9. The method as claimed in claim 6, wherein step a1) comprises a step of displaying a menu screen on the external output apparatus and inputting a color range change value via the menu screen.

* * * * *